US006082442A

United States Patent [19]

Michelbrink

[11] Patent Number: 6,082,442

[45] Date of Patent: Jul. 4, 2000

[54] APPARATUS FOR REMOVAL AND COOLING OF ASH FROM THE BED OF A FLUIDIZED BED FURNACE

[75] Inventor: Bernhard Michelbrink, Wesel, Germany

[73] Assignee: Babock Kraftwerkstechnik GmbH, Oberhausen, Germany

[21] Appl. No.: 09/082,401

[22] Filed: May 20, 1998

[30] Foreign Application Priority Data

May 21, 1997 [DE] Germany ..... 197 21 206

[51] Int. Cl.[7] ..... F28D 15/00; F23J 1/00; F23J 1/02; F23J 1/06

[52] U.S. Cl. ..... 165/104.18; 165/86; 110/165 R; 110/167; 432/235; 432/239

[58] Field of Search ..... 110/168, 165 A, 110/165 R, 245, 259, 344, 171, 167; 165/86, 120, 104.15, 104.16, 104.18; 432/15, 86, 233, 235, 236, 239; 414/147, 150, 152, 157, 209

[56] References Cited

U.S. PATENT DOCUMENTS

| | | | |
|---|---|---|---|
| Re. 34,814 | 1/1995 | Magaldi | 110/165 R |
| 668,583 | 2/1901 | Olsted | 110/165 R |
| 676,930 | 6/1901 | Wees et al. | 110/165 R |
| 1,049,561 | 1/1913 | Bradley | 110/165 R |
| 2,189,983 | 2/1940 | Harris | 432/239 X |
| 2,662,763 | 12/1953 | Heaps et al. | 110/171 X |
| 2,808,236 | 10/1957 | Dickinson | 165/120 X |
| 2,812,924 | 11/1957 | Hapman | 165/86 |
| 3,492,740 | 2/1970 | Geipel et al. | 165/104.18 X |
| 3,504,645 | 4/1970 | Davenport | 110/165 R X |
| 3,732,917 | 5/1973 | Deubel | 165/120 X |
| 3,915,105 | 10/1975 | Michelbrink | 110/165 R |
| 3,927,715 | 12/1975 | Castanoli | 165/120 |
| 4,301,746 | 11/1981 | Pech et al. | 110/165 R |
| 4,615,677 | 10/1986 | Hulek | 165/120 X |

FOREIGN PATENT DOCUMENTS

| | | | |
|---|---|---|---|
| 2 002 674 | 8/1971 | Germany | 110/165 R |
| 444157 | 3/1936 | United Kingdom | 165/120 |
| 497489 | 12/1938 | United Kingdom | 165/86 |

*Primary Examiner*—Ira S. Lazarus
*Assistant Examiner*—Ljiljana V. Ciric
*Attorney, Agent, or Firm*—Max Fogiel

[57] ABSTRACT

A floor (2) of the device communicates with one or more ash-extraction pipes (3) associated with a semi-cooled conveyor. The conveyor is a drag conveyor (5) that travels over a semi-cooled floor (12) inside a housing (4). Several such semi-cooled floors are positioned one above another at several levels. The floors (12) at each level are divided into several tables (16) separated by slots (17) that extend across the direction traveled by the conveyor. The tables are mutually displaced level by level such that the rear end of every table is above the front end of a table in the floor just below it.

6 Claims, 3 Drawing Sheets

APPARATUS FOR REMOVAL AND COOLING OF ASH FROM THE BED OF A FLUIDIZED BED FURNACE

BACKGROUND OF THE INVENTION

The present invention concerns a device for extracting and cooling ash from a fluidized bed.

The purpose of such a device is to extract the dry ash from the bed at 870° C. and cool it to below 300° C. Conveyors comprising semi-cooled screws accommodated in semi-cooled housings are known for this purpose. When the cooling system leaks, water penetrates into the interior and soaks the ash. The wet ash cakes up on the wall of the housing and clogs the conveyor, which breaks down.

Also known for extracting and cooling fluidized-bed ash are "trickle" coolers, wherein the cooling water flows through coils. The coils are in contact with the ash, which subjects them to considerable abrasion.

SUMMARY OF THE INVENTION

The object of the present invention is accordingly a device for extracting and cooling dry ash from a fluidized bed that will be simple and resistant to abrasion.

The drag conveyor in the device in accordance with the present invention is robust and resistant to abrasion. The semi-cooled floor that the chain travels over is provided in a simple way with wear-resistant plates. The presence of several semi-cooled floors ensures enough heat-exchange surfaces inside the conveyor's housing to satisfactorily cool even large volumes of ash. The mutual displacement of the tables that constitute the floors keeps the pile of ash on each table fairly low even when a lot of ash is being handled and accordingly promotes cooling.

BRIEF DESCRIPTION OF THE DRAWINGS

Several embodiments of the present invention will now be specified with reference to the accompanying drawing, wherein.

DESCRIPTION OF THE PREFERRED EMBODIMENTS

Figure 1:
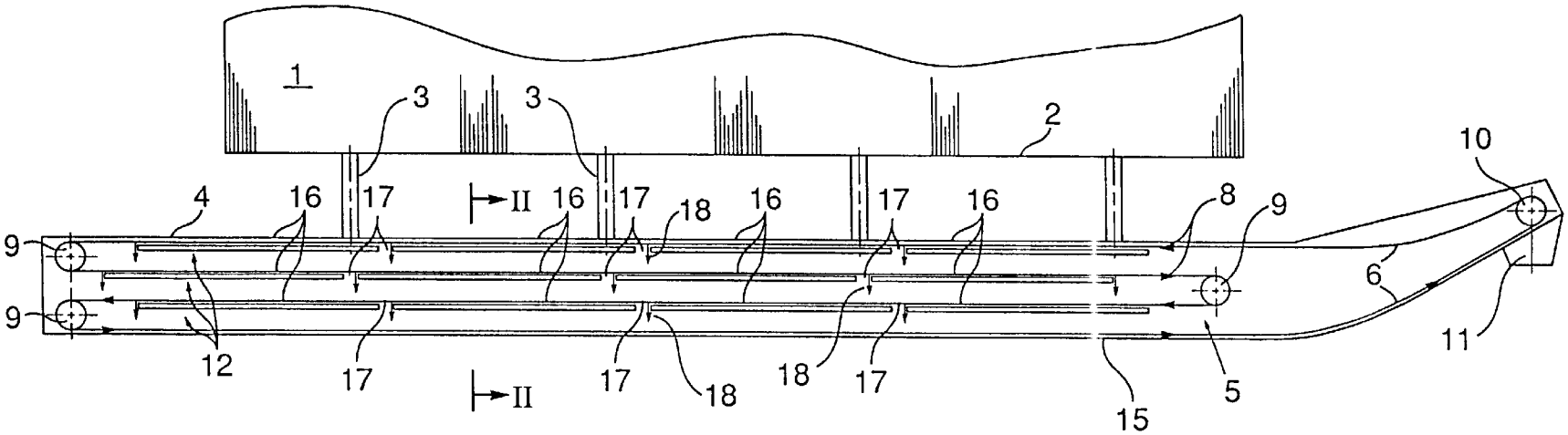
FIG. 1 is a schematic longitudinal section through a conveyor.
Figure 2:
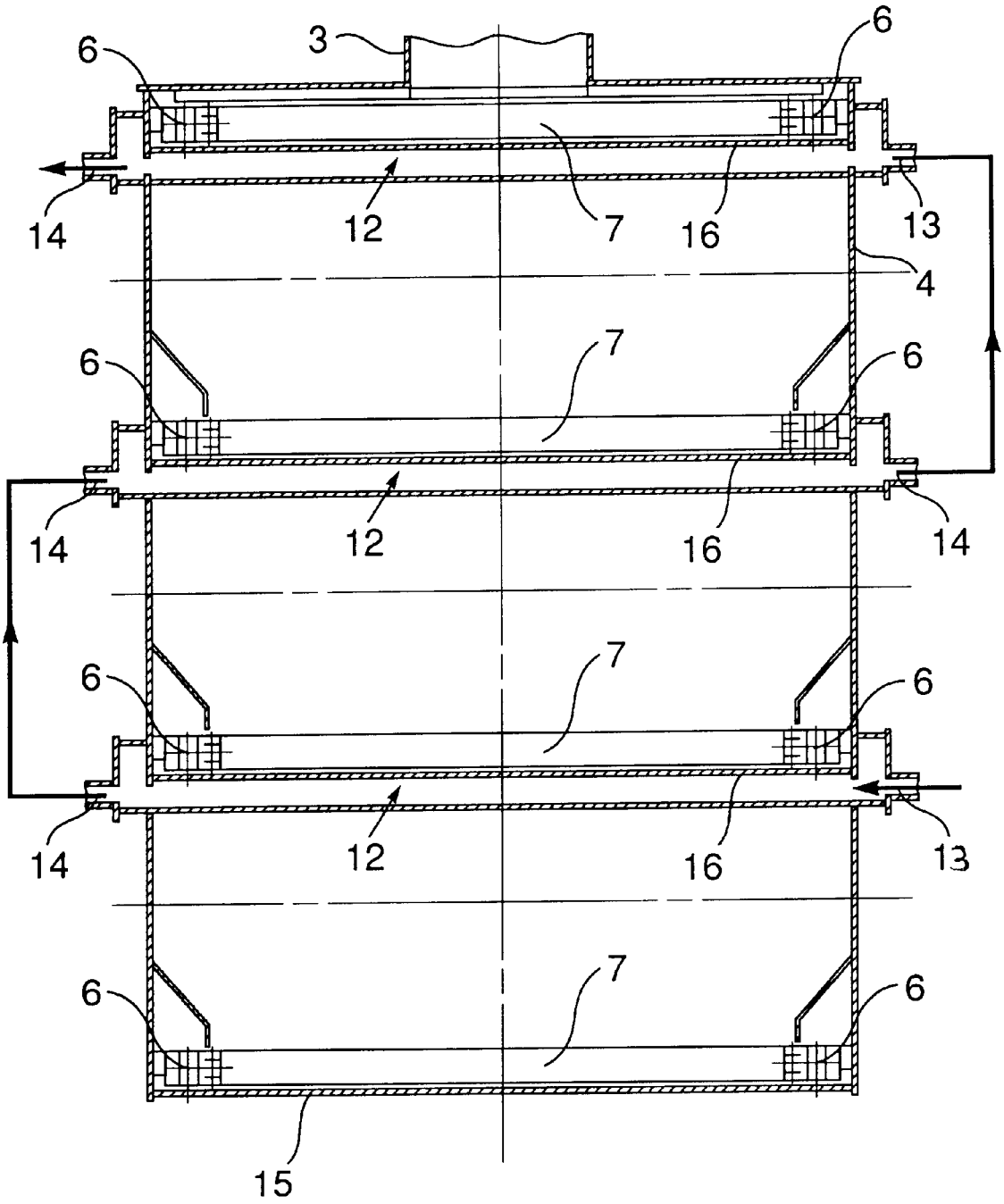
FIG. 2 is a section along the line II—II in FIG. 1, and FIGS. 3 and 4 are longitudinal sections through another type of conveyor.

Combustion air and fluidizing air are injected into the bottom half of the agitated-combustion chamber 1 of a fluidized bed to maintain a turbulent layer of fuel and ash. Some of the ash is to be extracted out of the system. The floor 2 of combustion chamber 1 is accordingly provided with several ash-extraction pipes 3 that communicate with an enclosed housing 4. Rotating inside housing 4 is a conveyor for conveying and cooling the dry ash extracted from the bed.

The conveyor is a drag conveyor 5 and comprises two parallel and circulating chains 6 connected together at intervals by scrapers 7. Chains 6 are represented by lines in FIGS. 1, 3, and 4, and arrows 8 indicate the direction traveled by the ash. Each chain 6 travels around deflection rollers 9 and around a motorized driving wheel 10. The ash is removed through a discharge 11 in housing 4.

The chains 6, connected by scrapers 7, travel over a floor 12. Floor 12 is hollow and provided with an intake 13 and an outlet 14 for a cooling medium, water for example. The upper wall of floor 12 is abrasion-resistant.

Several such floors 12 are stacked inside housing 4. The cooling medium flows through each floor 12 in turn, beginning with the lowermost. The chains 6 in the single drag conveyor 5 illustrated in FIG. 1 travel over each floor 12 in succession and finally over the floor 15 of housing 4. Since the chains are deflected several times, each strand travels opposite the one above or below it.

Floors 12 are divided into individual tables 16 along the direction of travel with a slot 17 between each pair of tables. The ash conveyed over a particular table 16 drops through a slot 17 either onto a table 16 in the semi-cooled floor 12 underneath the table 16 or onto the floor 15 of housing 4.

The tables 16 in semi-cooled floors 12 are mutually displaced from one level to the next. The rear end of one table 16, and its associated slot 17 as well accordingly, is above the front end of the table 16 below it. The ash travels through housing 4 and over floors 12 in the direction 18 indicated by the vertical arrows.

The mutual displacement of the tables 16 of floors 12 ensures that the same volume of ash will be conveyed over each table 16. The floor 15 of housing 4 will eventually receive the ash conveyed over all the tables 16 on one level. The piles of ash on each table will be relatively shallow in spite of the large total volume of ash being conveyed through the system. Heat will be removed from the ash as it travels over semi-cooled tables 16 and comes into contact with their surfaces. The shallowness of the individual piles will promote the removal of heat from the ash and into the cooling medium flowing through floors 12. Since the ash will also be stirred up as it drops from one table 16 to the one below it, the various portions of ash will come into contact with the surfaces and be cooled more thoroughly.

Figure 3:
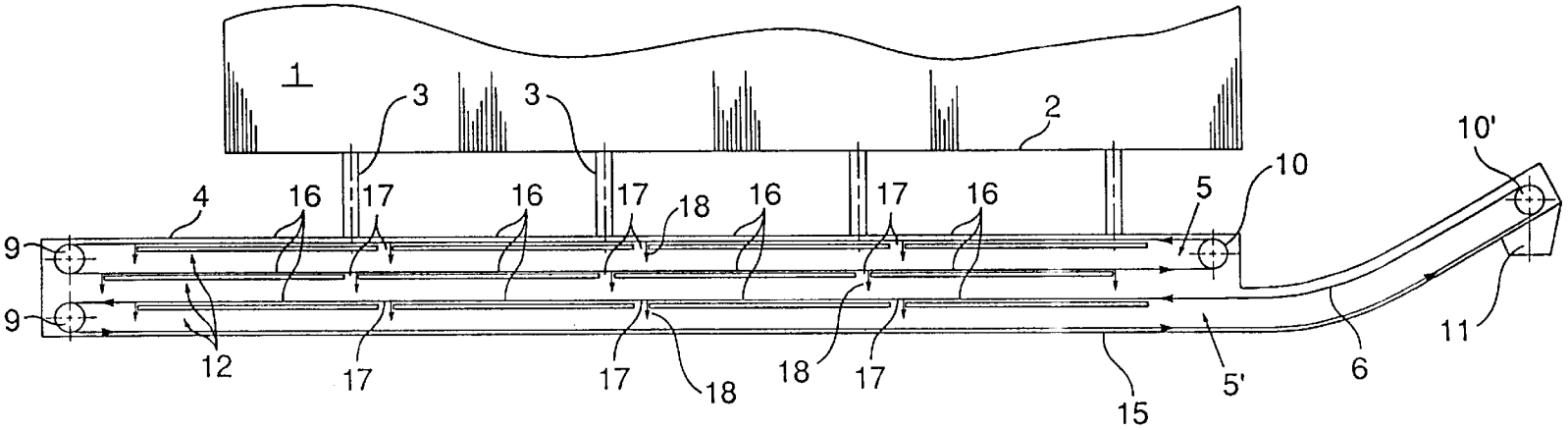
Figure 4:
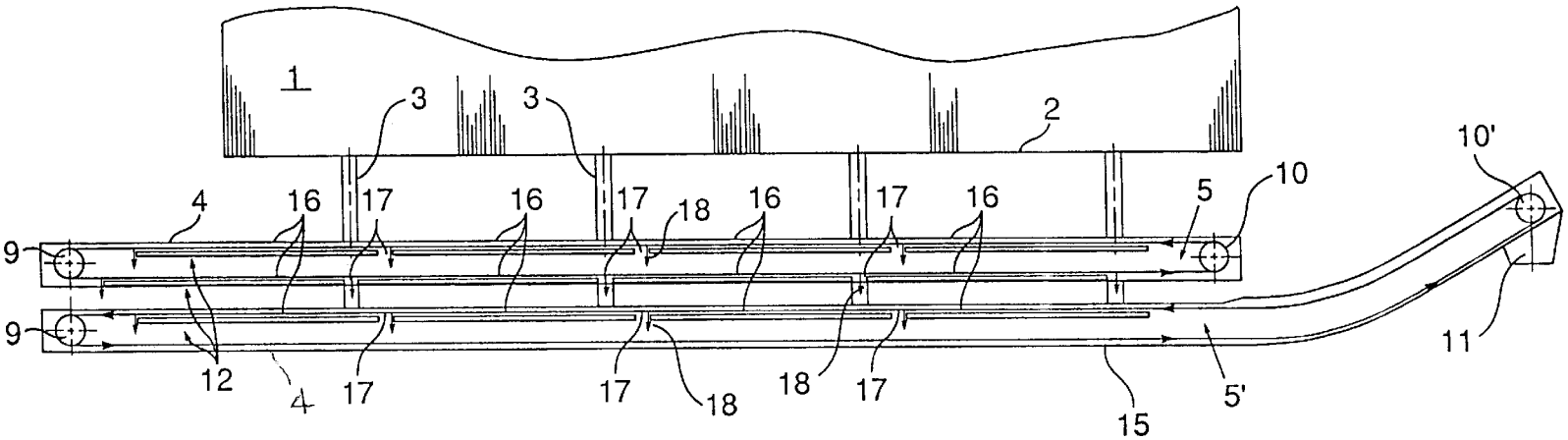

The tables 16 in the embodiments illustrated in FIGS. 3 and 4 are distributed as in the embodiment illustrated in FIG. 1. The conveyors are different, however. The embodiment illustrated in FIG. 3 features two drag conveyors 5 and 5', each with its own drive mechanism, in a single housing 4. Drag conveyor 5 travels over two semi-cooled floors 12 and drag conveyor 5' over one semi-cooled floor 12 and the floor 15 of housing 4. Since the floors 12 are again divided up into tables 16, however, the ash will travel as in the embodiment illustrated in FIG. 1.

The embodiment illustrated in FIG. 4 features a housing 4 directly under agitated-combustion chamber 1 and accommodating two medium-cooled floors 12. A drag conveyor 5 travels over floors 12. There is another housing 4' directly under housing 4 and accommodating another drag conveyor 5'. Housing 4' is provided with a discharge 11. Housings 4 and 4' communicate through chutes 19, through which the ash drops from upper housing 4 to lower housing 4'. Each chute 19 communicates in turn with a slot 17 between two of the tables 16 in the lower medium-cooled floor 12 of upper housing 4. Each chute 19 terminates above the front end of one of the upper tables 16 in second housing 4'.

What is claimed is:

1. An arrangement for extracting and cooling ash from a fluidized bed, comprising: a floor in said fluidized bed with at least one extraction pipe in said floor; a cooled conveyor operably connected to said extraction pipe, said cooled conveyor comprising a drag conveyor with two spaced chains and having means for separating said chains; a housing surrounding said cooled conveyor and having a plurality of cooled floors therein, said drag conveyor traveling over said cooled floors and pushing the ash over said cooled floors to bring the ash to be cooled in direct contact with said cooled floors, each of said plurality of cooled floors being located one above another to form a plurality of levels, each of said plurality of cooled floors also being divided into a plurality of tables separated by spaced slots extending transversely across the direction of travel of said cooled conveyor, each of said plurality of tables on any one level being displaced in said direction of travel relative to the tables of a neighboring level which is disposed below said any one level so that a rear end, relative to said direction of travel, of each of said plurality of tables on said any one level is above a front end, relative to said direction of travel of a corresponding table on any one neighboring immediately level.

2. The arrangement as defined in claim 1, wherein said drag conveyor has a plurality of deflected chains traveling over said tables of said cooled floors.

3. An arrangement as defined in claim 1, including additional drag conveyors in said housing, each of said additional drag conveyors traveling over at least one of said cooled floors.

4. An arrangement as defined in claim 1, including at least one additional housing with at least one cooled additional floor below said first-mentioned housing; an additional drag conveyor in said additional housing; at least one chute communicating with said first-mentioned housing and with both said additional at least one housing and said additional drag conveyor.

5. An arrangement as defined in claim 4, wherein said at least one chute comprises a plurality of chutes, each of said chutes opening into said additional housing and being adjacent to one of said slots between tables.

6. An arrangement as defined in claim 1, wherein said extraction pipe opens into said housing above a front end, relative to said direction of travel, of one of said plurality of tables.

* * * * *